US006071362A

United States Patent [19]

Mertens

[11] Patent Number: 6,071,362

[45] Date of Patent: Jun. 6, 2000

[54] METHOD AND PLANT FOR ROLLING HOT-ROLLED WIDE STRIP FROM CONTINUOUSLY CAST SLABS

[75] Inventor: Werner Mertens, Viersen, Germany

[73] Assignee: SMS Schloemann-Siemag Aktiengesellschaft, Düsseldorf, Germany

[21] Appl. No.: 09/039,536

[22] Filed: Mar. 16, 1998

[30] Foreign Application Priority Data

Mar. 24, 1997 [DE] Germany ..... 197 12 212

[51] Int. Cl.[7] ..... C21D 5/00

[52] U.S. Cl. ..... 148/541; 148/545; 164/418; 29/33 C

[58] Field of Search ..... 148/557, 541, 148/544, 545; 164/418, 476; 29/33 C; 266/142

[56] References Cited

U.S. PATENT DOCUMENTS 4,601,762 7/1986 Pirlet .
5,542,165 8/1996 Coassin et al. ..... 29/33 C
5,769,149 6/1998 Mertens ..... 164/418

FOREIGN PATENT DOCUMENTS 0665296 8/1995 European Pat. Off. .

*Primary Examiner*—Scott Kastler
*Attorney, Agent, or Firm*—Friedrich Kueffner

[57] ABSTRACT

A method and a plant for rolling hot-rolled wide strip from continuously cast thin slabs or slabs of medium thickness of about 40 to 100 mm, wherein the cast slab strand is divided into sections, is subjected to a temperature treatment in a continuous furnace, and is conveyed for rolling into a rolling train. The temperature treatment of a slab section on the continuous furnace is interrupted by a surface treatment and the surface treatment of the slab section is carried out in the production line between the casting plant and the rolling train. The plant for carrying out the method includes a continuous casting plant for thin slabs, a transverse cutting device, a continuous furnace and a rolling train, wherein the continuous furnace, for example, a roller-hearth furnace, is divided into two segments between which is arranged in an in-line position a surface treatment unit for treating deficient slab sections.

7 Claims, 2 Drawing Sheets

METHOD AND PLANT FOR ROLLING HOT-ROLLED WIDE STRIP FROM CONTINUOUSLY CAST SLABS

BACKGROUND OF THE INVENTION

1. Field of the Invention

The present invention relates to a method and to a plant for rolling hot-rolled wide strip from continuously cast thin slabs or slabs of medium thickness of about 40 to 100 mm, wherein the cast slab strand is divided into sections, is subjected to a temperature treatment in a continuous furnace, and is conveyed for rolling into a rolling train.

2. Description of the Related Art

EP-A2 0 327 854 discloses a method and a plant for rolling initial strips cast on a continuous strip casting plant in a hot-rolling wide strip finishing rolling train, wherein the cast initial strips divided into initial strip lengths are subjected to a thermal treatment in a roller-hearth furnace in which a homogeneous rolling temperature is imparted to the initial strips. Immediately before entering the finishing rolling train, the initial strip lengths are descaled.

In the manufacture of thin slabs, it is frequently difficult to ensure the demanded surface quality over the entire length of the thin slab strand. Especially the first sections of the thin slabs cast at the beginning of casting or after a casting interruption may have deficiencies of the surface properties which will result in a quality reduction of the rolled sheet metal.

In order to eliminate this disadvantage, it is proposed in a not yet published German patent application (Serial No. P 196 21 259.6), to pull any slab sections which have deficiencies from the main production line, to carry out a surface treatment by grinding or by flame-treating, and subsequently to return the slab sections treated in this manner back into the main production line. For this purpose, the roller-hearth furnace, in which the slab sections are heated to a homogeneous rolling temperature, is formed over a partial length thereof by at least one portion which is transversely moveable into a side position, wherein the side position is in alignment with the surface treatment line. The slab sections to be treated are heated by this moveable furnace portion, are moved transversely into a side position of the roller-hearth furnace, are treated at their surfaces while being conveyed in longitudinal direction, are subsequently returned into the heating position on the side and are then returned in the heated condition transversely into the main production line. In accordance with this procedure, it is now possible to treat slab sections at their surfaces without interrupting the remaining production sequence.

The disadvantage of this known method is the fact that for carrying out the surface treatment it is necessary to install a separate processing line in which the slab sections must be moved forward and then again backward, wherein the apparatus required for this purpose is expensive and requires a large amount of space.

SUMMARY OF THE INVENTION

Therefore, it is the primary object of the present invention to further develop the above-mentioned method in order to be able to carry out an improved treatment of deficient surfaces of slab sections in an appropriately constructed plant in a simpler, less expensive and space-saving manner.

In accordance with the present invention, in a method of the above-described type for rolling hot-rolled wide strip from continuously cast thin slabs or slabs of medium thickness of 40 to 100 mm, the temperature treatment of a slab section on the continuous furnace is interrupted by a surface treatment and the surface treatment of the slab section is carried out in the production line between the casting plant and the rolling train.

Consequently, in accordance with the present invention, an in-line surface treatment of deficient slab sections is possible without having to move the slab sections out of the production line.

In accordance with an advantageous further development of the invention, the surface treatment, which may constitute grinding or flame-treating of the deficient surface area, may be carried out, depending on the distance between the transverse cutting unit or shear and the surface treatment unit, at a variable speed which deviates from the casting speed.

For example, if this distance between the shear and the surface treatment unit corresponds to a slab section length, the surface treatment speed may be equal to or greater than the casting speed.

On the other hand, if the distance between the surface treatment unit and the transverse cutting unit corresponds, for example, to twice the slab section length, a single slab section could also be treated with half the casting speed, or two slab sections could be treated with three quarters of the casting speed.

The method of the invention provides the advantage that any variations in the casting speed, for example, due to problems or at the end of a sequence, no longer negatively affect the sequence of the surface treatment.

Since at the beginning of the surface treatment the respective slab sections have already travelled through a portion of the heating unit, a uniform temperature profile over the width and length of the slab sections is already present; this has an advantageous effect on a uniform grinding abrasion if the surface treatment is carried out by grinding.

When slab sections are not to be treated, they can travel through the surface treatment unit at a high conveying speed of up to a maximum of 90 m/min, so that only a small temperature loss occurs.

After the surface treatment, the slab sections are further thermally treated in order to reach the desired temperature profile which is required for subsequent rolling. Since the temperature equalization in the continuous furnace, for example, a roller-hearth furnace, has been interrupted by the surface treatment, particularly if grinding is carried out, and the temperature equalization is continued after the surface treatment, the length of the continuous furnace increases in comparison to a continuous furnace without surface treatment if the same buffer capacities are to be provided. This means that the length of the continuous furnace increases additionally depending on the space requirement of the surface treatment unit. In new plants, this space requirement can be realized in an easy manner.

However, if the in-line surface treatment according to the present invention is to be integrated into an existing plant configuration in which an extension of the length of the continuous furnace is not possible, the required extension of the temperature treatment can be carried out in accordance with the present invention in such a way that a conveyor of a laterally moveable segment of the continuous furnace which is constructed as a double conveyor remains over a certain period of time filled with a slab section laterally next to the continuous furnace in an off-line position and the buffer capacity of the continuous furnace is increased to the desired quantity in this manner, while the other conveyor is arranged in the in-line position in the production line and forms part of the continuous furnace. Of course, this possibility of constructing a continuous furnace segment as a heatable double conveyor can also be included in new plants in order to reduce the length of the continuous furnace.

In a plant for carrying out the method according to the present invention, wherein the plant includes a continuous casting plant for thin slabs, a transverse cutting device, a continuous furnace and a rolling train, the continuous furnace, for example, a roller-hearth furnace, is divided into two segments between which is arranged in an in-line position a surface treatment unit for treating deficient slab sections.

This type of continuous furnace may further be divided into additional segments, wherein one segment is constructed as a heatable double conveyor, wherein individual conveyors are transversely moveable alternately from the production line into an off-line side position in order to increase the buffer capacity of the continuous furnace.

The surface treatment unit may be a hot grinding unit which is provided with a roller table. Alternatively, the surface treatment unit may be a flame-treating machine provided with a roller table. The roller table provided for the hot grinding unit or the flame-treating machine is advantageously screened to prevent heat losses.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
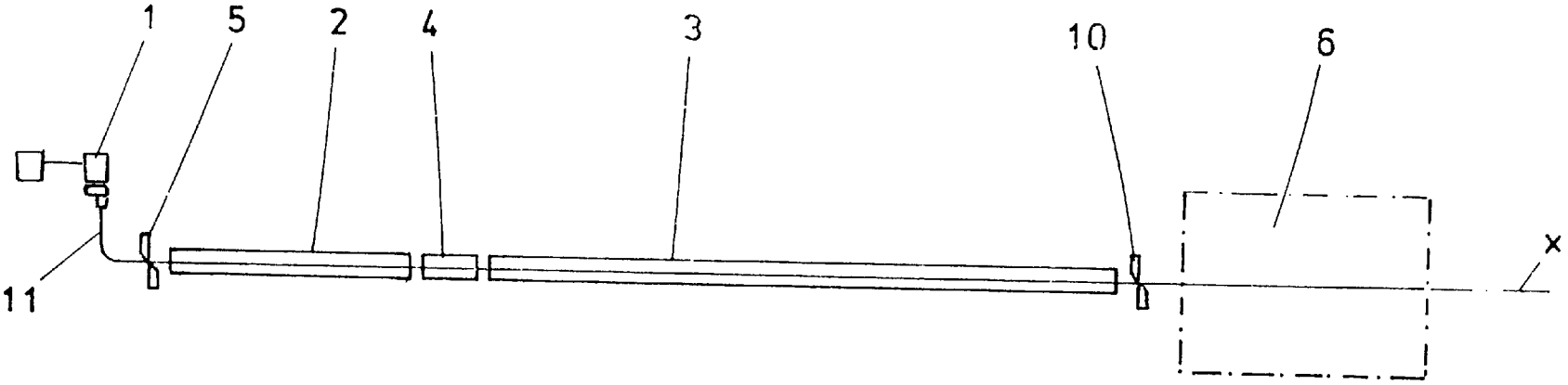
FIG. 1 is a schematic side view of a plant for rolling hot-rolled wide strip.
Figure 2:
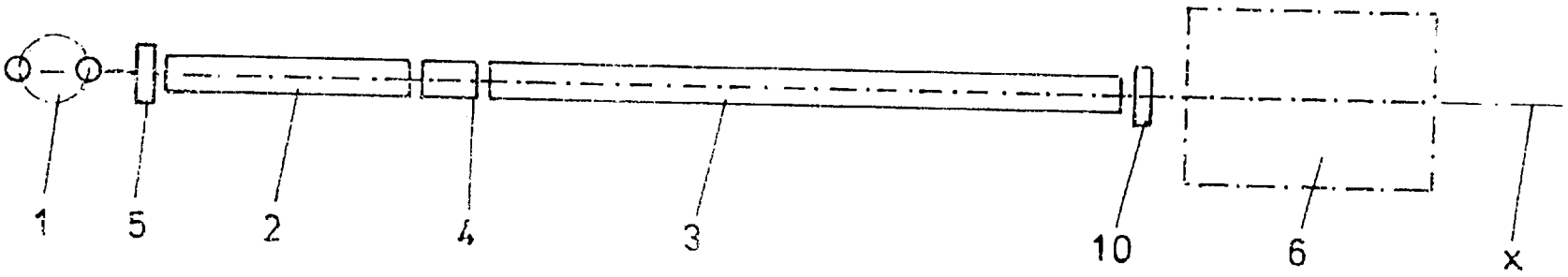
FIG. 2 is a top view of the plant of FIG. 1.

As illustrated in FIGS. 1 and 2, the plant for rolling hot-rolled strip essentially is composed of a continuous casting plant 1 for a thin slab strand of about 40 to 100 mm thickness, a transverse cutting unit 5, for example, a shear, a continuous furnace 2, 3, for example, a roller-hearth furnace, and another shear 10, as well as a rolling train 6.

Figure 3:
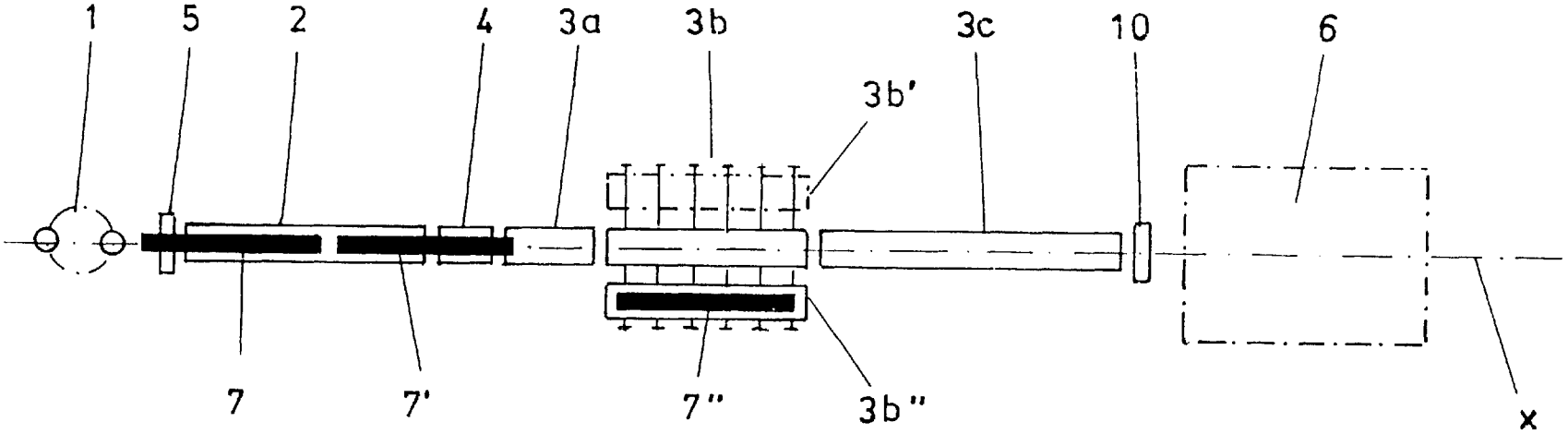
FIG. 3 is a top view of a plant for rolling hot-rolled wide strip with a double transverse conveyor integrated into the continuous furnace.

The continuous furnace 2, 3 is composed of the segments 2 and 3 between which is arranged a surface treatment unit 4. The front continuous furnace segment 2 has such a length that the distance of the surface treatment unit 4 from the transverse cutting unit 5 corresponds at least to the length of a slab section 7, as shown in FIG. 3. After being deflected into the horizontal production line x, the cast thin slab strand 11 is cut by the transverse cutting unit 5 into slab sections 7 having the desired length and is introduced into the continuous furnace 2, 3.

Slab sections 7 which have an insufficient surface quality are treated in the surface treatment unit 4 arranged between the continuous furnace segments 2 and 3, wherein the feeding speed within the surface treatment unit 4 may deviate from the casting speed depending on the length of the distance between the transverse cutting unit 5 and the surface treatment unit 4 which corresponds at least to the length of the slab section 7.

On the other hand, slab sections 7 which have sufficient surface quality are conveyed with increased speed through the surface treatment unit 4 into the next continuous furnace segment 3. The slab sections 7 heated to homogeneous rolling temperature in the continuous furnace 2,3 are subsequently finish-rolled in the rolling train 6, wherein the slab sections may be first cut once again as needed by means of the shear 10.

In contrast to the plant shown in FIGS. 1 and 2, in the plant schematically illustrated in FIG. 3 the continuous furnace segment 3 is further divided into altogether 3 segments 3*a*, 3*b*, 3*c*. The middle segment 3*b* is constructed as a heatable double transverse conveyor with individual conveyors which each have a length which makes it possible that they can receive a slab section. The double conveyor is transversely displaceable, so that always one individual conveyor is arranged in an in-line position in the production line x, while the other conveyor 3*b*" is then in an off-line position next to the production line x, i.e., also laterally next to the continuous furnace.

As shown in FIG. 3, an individual conveyor 3*b*, filled with a slab section 7", is located in the lateral position or off-line positions 3*b*", so that the buffer capacity is increased by this slab section 7". At the same time, the other individual conveyor is located in the production line x and constitutes a portion of the continuous furnace. After a certain heating period, the conveyor containing the now heated slab 7" is moved back from the off-line position 3*b*" into the production line x and the slab 7" is conveyed into the continuous furnace segment 3*c* in order to continue the thermal treatment. Simultaneously, the other individual conveyor, either empty or filled with a slab section 7' as needed, is moved out of the production line x and into the off-line position 3*b*'. In this manner, when the surface treatment unit is subsequently mounted into an existing continuous furnace, the buffer capacity of the continuous furnace 2, 3 can be adapted to the thermal requirements depending on the heating duration outside of the production line x for obtaining a homogeneous rolling temperature.

The continuous furnace segment 3*a* is required to make it possible to transversely move the double conveyor filled with a slab section because this makes it possible after the surface treatment to produce a gap to the next following slab section 7' which is still to be treated and the double conveyor can be moved unimpededly by a slab section 7 emerging from the surface treatment unit 4.

Only one production line each is shown in the figures of the drawing. However, in accordance with the present invention, the strand may also be one of a 2×1 continuous plant or one of a two-strand casting plant.

While specific embodiments of the invention have been shown and described in detail to illustrate the inventive principles, it will be understood that the invention may be embodied otherwise without departing from such principles.

I claim:

1. A method of rolling hot-rolled wide strip from continuously cast thin slabs or slabs of medium thickness of about 40 to 100 mm, the method comprising dividing a cast slab strand into sections, subjecting the sections in segments of a continuous furnace to a temperature treatment and conveying the sections for rolling to a rolling train, further comprising interrupting the temperature treatment of a slab section between two segments of the continuous furnace for carrying out a surface treatment comprised of at least one of a grinding process and a flame-treatment process and carrying out the surface treatment of the slab section between the two segments in a single production line between a casting plant and the rolling train.

2. The method according to claim 1, comprising carrying out the surface treatment at a speed deviating from a casting speed.

3. The method according to claim 1, comprising, after carrying out the surface treatment of the slab sections, carrying out a further thermal treatment of the slab sections partially in a portion of the continuous furnace located laterally next to the production line in a segment of the continuous furnace configured as a heatable double conveyor.

4. A plant for rolling hot-rolled wide strip from continuously cast thin slabs or slabs of medium thickness of about 40 to 100 mm, the plant comprising arranged in a single production line a continuous furnace between a casting plant and a rolling train, the casting furnace comprising segments, further comprising a surface treatment unit arranged between the segments, wherein the surface treatment unit is at least one of a grinding unit and a flame-treating unit.

5. The plant according to claim 4, further comprising a transverse cutting unit arranged in a conveying direction in front of the surface treatment unit, wherein a distance between the transverse cutting unit and the surface treatment unit corresponds at least to a length of a slab section.

6. The plant according to claim 5, wherein the transverse cutting unit is a shear.

7. The plant according to claim 4, wherein one of the continuous furnace segments comprises a plurality of additional segments arranged one behind the other in a conveying direction, wherein one of the additional segments comprises a heatable double conveyor extending parallel to the conveying direction and moveable transversely of the conveying direction, such that a first conveyor of the heatable double conveyor is located in a lateral position of the production line and a second conveyor of the heatable double conveyor is located in the production line.

* * * * *